US011885245B2

(12) United States Patent
Barve

(10) Patent No.: US 11,885,245 B2
(45) Date of Patent: Jan. 30, 2024

(54) OIL PRESSURE ACTUATED PHASER WITH A LOCK PIN SHUTOFF

(71) Applicant: BorgWarner, Inc., Auburn Hills, MI (US)

(72) Inventor: Anand Barve, Lansing, NY (US)

(73) Assignee: BORGWARNER INC., Auburn Hills, MI (US)

( * ) Notice: Subject to any disclaimer, the term of this patent is extended or adjusted under 35 U.S.C. 154(b) by 0 days.

(21) Appl. No.: 17/669,807

(22) Filed: Feb. 11, 2022

(65) Prior Publication Data

US 2023/0258108 A1 Aug. 17, 2023

(51) Int. Cl.
*F01L 1/344* (2006.01)

(52) U.S. Cl.
CPC ..... *F01L 1/3442* (2013.01); *F01L 2001/3443* (2013.01); *F01L 2001/34423* (2013.01); *F01L 2001/34426* (2013.01); *F01L 2001/34433* (2013.01); *F01L 2001/34453* (2013.01); *F01L 2001/34469* (2013.01)

(58) Field of Classification Search
None
See application file for complete search history.

(56) References Cited

U.S. PATENT DOCUMENTS

2011/0088645 A1* 4/2011 Yamaguchi ..... F01L 1/3442 123/90.17
2011/0259289 A1* 10/2011 Fujiyoshi ..... F01L 1/3442 123/90.15

* cited by examiner

*Primary Examiner* — Wesley G Harris
(74) *Attorney, Agent, or Firm* — Brown & Michaels, PC

(57) ABSTRACT

An oil pressure actuated or torsion assisted phaser with a lock pin that has a position which shuts off communication between the advance and retard chambers and the front cam bearing and/or oil control valve, effectively acting as a shutoff valve and preventing leakage of oil from the advance and retard chambers. The prevention of leakage maintains oil in the phaser after engine shutdown. Additionally, by shutting off communication between the advance and retard chambers and the oil supply, the side load on the lock pin from the oil pressure torque on the rotor vanes during unlocking of the lock pin can be reduced or eliminated.

26 Claims, 12 Drawing Sheets

OIL PRESSURE ACTUATED PHASER WITH A LOCK PIN SHUTOFF

BACKGROUND

The present invention relates to camshaft phasers, and more specifically to a camshaft phaser with a lock pin which shuts off communication between the advance and retard chambers of the phaser and the oil control and/or the front cam bearing.

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). Vane phasers have a rotor assembly with one or more vanes, mounted to the end of the camshaft, surrounded by a housing assembly defining the vane chambers into which the vanes fit. It is possible to have the vanes mounted to the housing assembly, and the chambers in the rotor assembly, as well. The housing assembly's outer circumference forms the sprocket, pulley or gear accepting drive force through a chain, belt, or gears, usually from the crankshaft, or possible from another camshaft in a multiple-cam engine.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated VCT systems, an oil control valve (OCV) directs engine oil pressure to one working chamber in the VCT phaser while simultaneously venting the opposing working chamber defined by the housing assembly, the rotor assembly, and the vane. This creates a pressure differential across one or more of the vanes to hydraulically push the VCT phaser in one direction or the other. Neutralizing or moving the oil control valve to a null position puts equal pressure on opposite sides of the vane and holds the phaser in any intermediate position. If the phaser is moving in a direction such that engine valves will open or close sooner, the phaser is said to be advancing and if the phaser is moving in a direction such that engine valves will open or close later, the phaser is said to be retarding. The OCV is typically remotely located from the phaser for OPA VCT systems but can also be located within the phaser or in the center bolt assembly that is mounted within the phaser.

The torsional assist (TA) systems operates under a similar principle with the exception that it has one or more check valves to prevent the VCT phaser from moving in a direction opposite than being commanded, should it incur an opposing force such as cam torque reversals. The oil control valve is typically located within the phaser or in a center bolt assembly that is mounted within the phaser for TA VCT systems.

Some VCT phasers have lock pins which are moveable between a locked position in which the lock pin engages an end plate of the housing assembly and an unlocked position. In the locked position, the movement of the rotor assembly relative to the housing assembly is prevented.

In conventional systems, just prior to engine shutdown, the lock pin is moved to the locked position by either venting fluid or supplying pressure to move the lock pin, such that the lock pin engages the recess in the end plate. At engine shutdown, depending on the locked position any fluid present within the advance or retard chamber leaks by draining out the clearance in the front cam bearing and/or an oil control valve (remote or centrally located within the phaser or the central bolt assembly). When the engine is restarted, no oil is present in the advance or retard chambers due to leakage that occurred and the advance and retard chambers can be instead filled with a pocket of air. On subsequent engine start up this causes delay in building oil pressure to unlock the lock pin and/or upon unlock of the pin oscillation of the vane. This can cause excessive side load on the lock pin and/or receiver as the lock pin unlocks as oil is reintroduced to the system. This can result in excessive wear of the lock pin and/or lock pin receiver plus result in start up noise vibration harshness (NVH) rattle noise. Another drawback in conventional systems is that when commanded to unlock, the oil pressure simultaneously acts on the lock pin to unlock, but also on one side of the rotor vane to actuate the phaser. Application of this oil pressure too quickly causes the oil pressure torque on the rotor vane to bind the lock pin against the receiver, which adds delay in the time it takes for the lock pin to unlock and in severe cases prevents the lock pin from unlocking.

SUMMARY

According to one embodiment of the present invention, an oil pressure actuated or torsion assisted phaser with a lock pin that has a position which shuts off communication between the advance and retard chambers and the front cam bearing and/or oil control valve, effectively acting as a shutoff valve and preventing leakage of oil from the advance and retard chambers. The prevention of leakage maintains oil in the phaser after engine shutdown. Additionally, during unlocking of the lock pin, oil is routed such that no oil pressure is applied to the vane until the lock pin is moved to the unlocked position, preventing binding of the lock pin dur to oil pressure torque on the vane.

DETAILED DESCRIPTION

Figure 1:
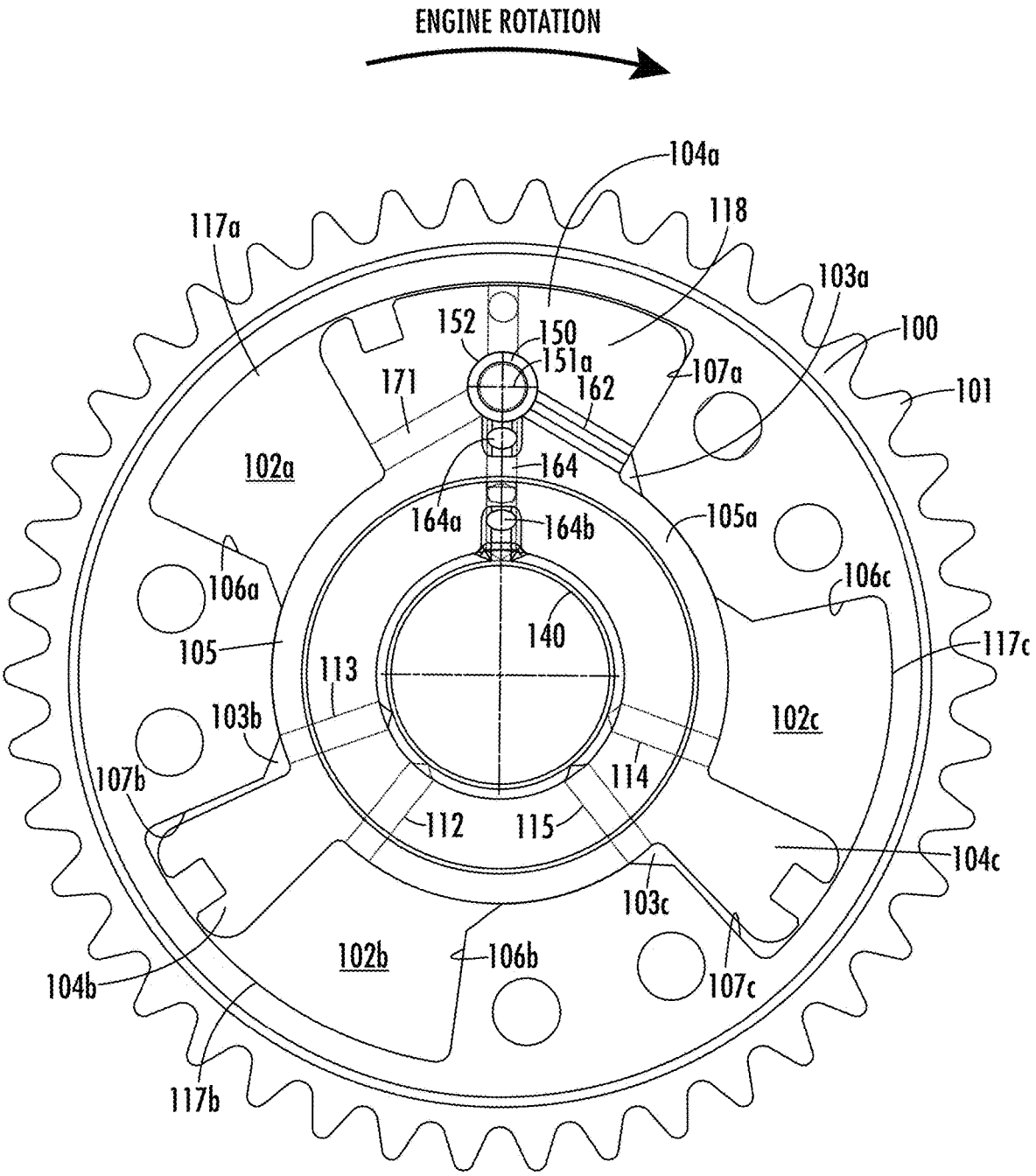
FIG. 1 shows a phaser of a first embodiment with a straight lock pin in a locked position.

The present invention provides a lock pin which has a locked position which shuts off or prevents communication between the advance and retard chambers and the front cam bearing and/or oil control valve. By preventing communication between the advance and retard chambers of the phaser and the cam bearing and/or the oil control valve, two advantages can be gained. First, leakage of oil from the advance and retard chambers is prevented. The prevention of leakage maintains oil in the phaser after shutdown. Second, when oil pressure is applied to unlock the lock pin, the load on the lock pin from the oil pressure torque on the rotor can be reduced or eliminated.

FIGS. 1-4 show a phaser of a first embodiment with a straight lock pin in locked and unlocked positions. The arrow shown on FIGS. 1 and 3 indicate the clockwise camshaft rotation. In this embodiment, when the engine is shutdown, the phaser is commanded to the full advanced position and the lock pin 150 is locked.

The housing assembly 100 of the phaser has an outer circumference 101 for accepting drive force as well as a first end plate 100*a* and a second end plate 100*b*. The first end plate has a recess 154 for receiving a lock pin 150 and an inner diameter surface 110. The inner diameter surface 110 may or may not be the phaser bearing.

A rotor assembly 105 is coaxially located within the housing assembly 100 and is connected to the camshaft (not shown). A central bore 140 has multiple annuli 140*a*, 140*b* with annuli 140*a* adjacent the second end plate 100*b* and annuli 140*b* adjacent the first end plate 100*a*. The central bore 140 is in fluid communication with an oil supply, a sump or exhaust, and multiple oil passages. In this embodiment, the oil control valve is shown as a remote oil control valve, remotely located from the phaser with multiple oil passages in fluid communication with annuli of the central bore 140. Alternatively, the oil control valve can also be center mounted in the phaser or center mounted as part of the center bolt assembly. The control valve can be received directly within a central bore 140 of the rotor assembly 105 or within a sleeve which is received within the central bore 140 of the rotor assembly 105.

The position of the oil control valve is controlled by an engine control unit (ECU) which controls the duty cycle of a variable force solenoid or other actuator. The ECU preferably includes a central processing unit (CPU) which runs various computational processes for controlling the engine, memory, and input and output ports used to exchange data with external devices and sensors.

Extending axially from the central hub 105*a* of the rotor assembly 105 are a plurality of vanes 104*a*-104*c* separating chambers 117*a*-117*c* formed between the housing assembly 100 and the rotor assembly 105 into advance chambers 102*a*-102*c* and retard chambers 103*a*-103*c*. Each of the chambers 117*a*-117*c* each have a retard wall 106*a*, 106*b*, 106*c* and a corresponding advance wall 107*a*, 107*b*, 107*c* which is separated by a distance. The vanes 104*a*-104*c* are capable of rotation to shift the relative angular position of the housing assembly 100 and the rotor assembly 105.

Advance passages 112, 114 are present between the central hub 105*a* of the rotor assembly 105, the advance chambers 102*b*, 102*c*, and annulus 140*a*. Retard passages 113, 115 are present between the central hub 105*a* of the rotor assembly 105, the retard chambers 103*b*, 103*c*, and annulus 140*b*.

At least one of the vanes 104*a* includes a bore 152 which receives a lock pin 150. The lock pin 150 has a body 151 with a first end or nose end 151*a*, a second end 151*g*, opposite the first end 151*a*, a first land 151*b*, a second land 151*c*, and a third land 151*d*. Between the first land 151*b* and the second land 151*c* is a first annulus 151*e* and between the second land 151*c* and the third land 151*d* is a second annulus 151*f*. The first end or nose end 151*a* has full diameter that engages the recess 154.

Along the bore 152 in the vane 104*a* receiving the lock pin 150 is: a connection to an oil passage 161 in fluid communication with annulus 140*a*, a vane passage 171 connected to the advance chamber 102*a*, a connection to a face passage 162 on the face 118 of the vane 104*a* adjacent the first end plate 100*a* and in communication with the retard chamber 103*a*, a first end 164*a* of a rotor passage 164 connected to the annulus 140*b* of the central bore. In one embodiment, the face passage 162 and the rotor passage 164 are restricted passages. The restricted passages 162 and 164 are preferably worm trails.

The lock pin 150 is moveable between an unlocked position and a locked position. In the locked position, the first end or nose end 151*a* engages with a recess 154 present in the first end plate 100*a*. A bushing 153 can be present in the recess 154 to more securely receive the first end 151*a* of the lock pin 150 in the locked position and define a passage 166 around the nose end 151*a* of the lock pin 150 between the bushing 153 and the recess 154.

Figure 2:
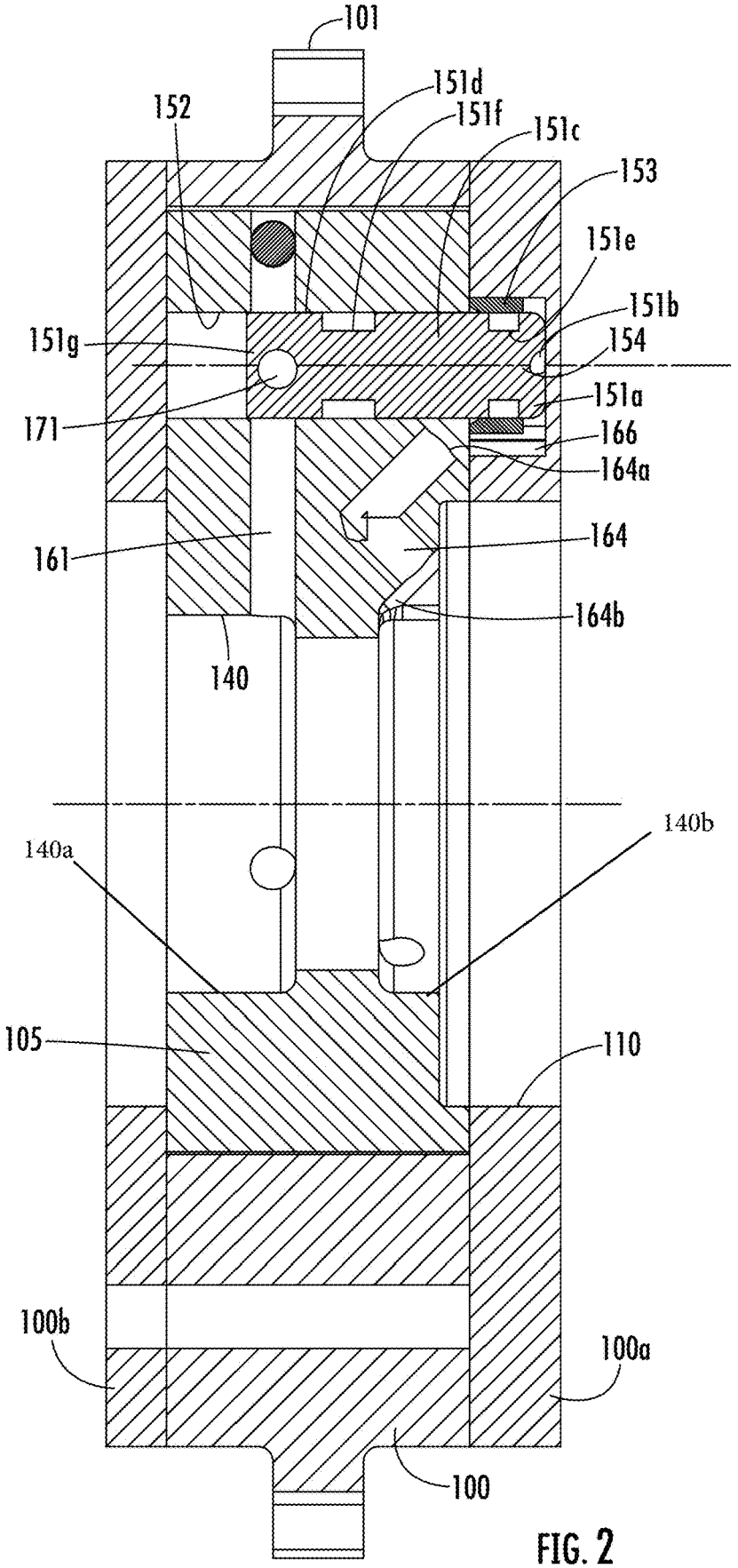
FIG. 2 shows a sectional view of the phaser of FIG. 1.

When the lock pin 150 is in the locked position as shown in FIGS. 1-2, the third land 151*d* blocks the flow of fluid from the advance chamber 102*a* by blocking both vane passage 171 and oil passage 161 leading to annulus 140*a* of the central bore 140, thereby preventing fluid from exiting the advance chamber 102*a*. With the lock pin 150 in the locked position, movement of the rotor assembly 105 relative to the housing assembly 100 is prevented. In this embodiment, the phaser is shown in the full advance position. The "full advance position" is defined as the position at which at least one vane 104*a*-104*c* contacts the retard wall 107*a*-107*c*.

Figure 3:
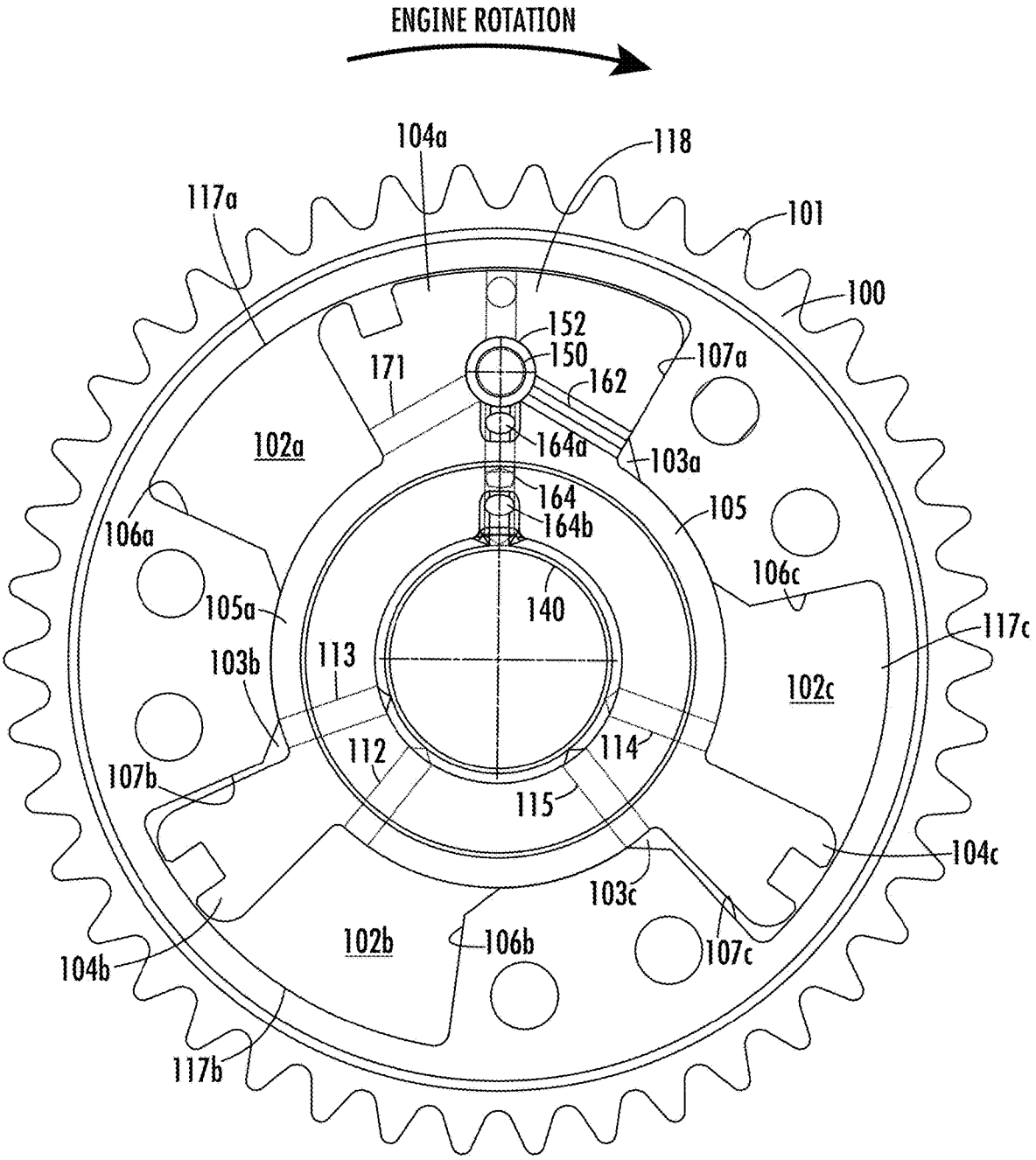
FIG. 3 shows a phaser of a first embodiment with a straight lock pin un an unlocked position.
Figure 4:
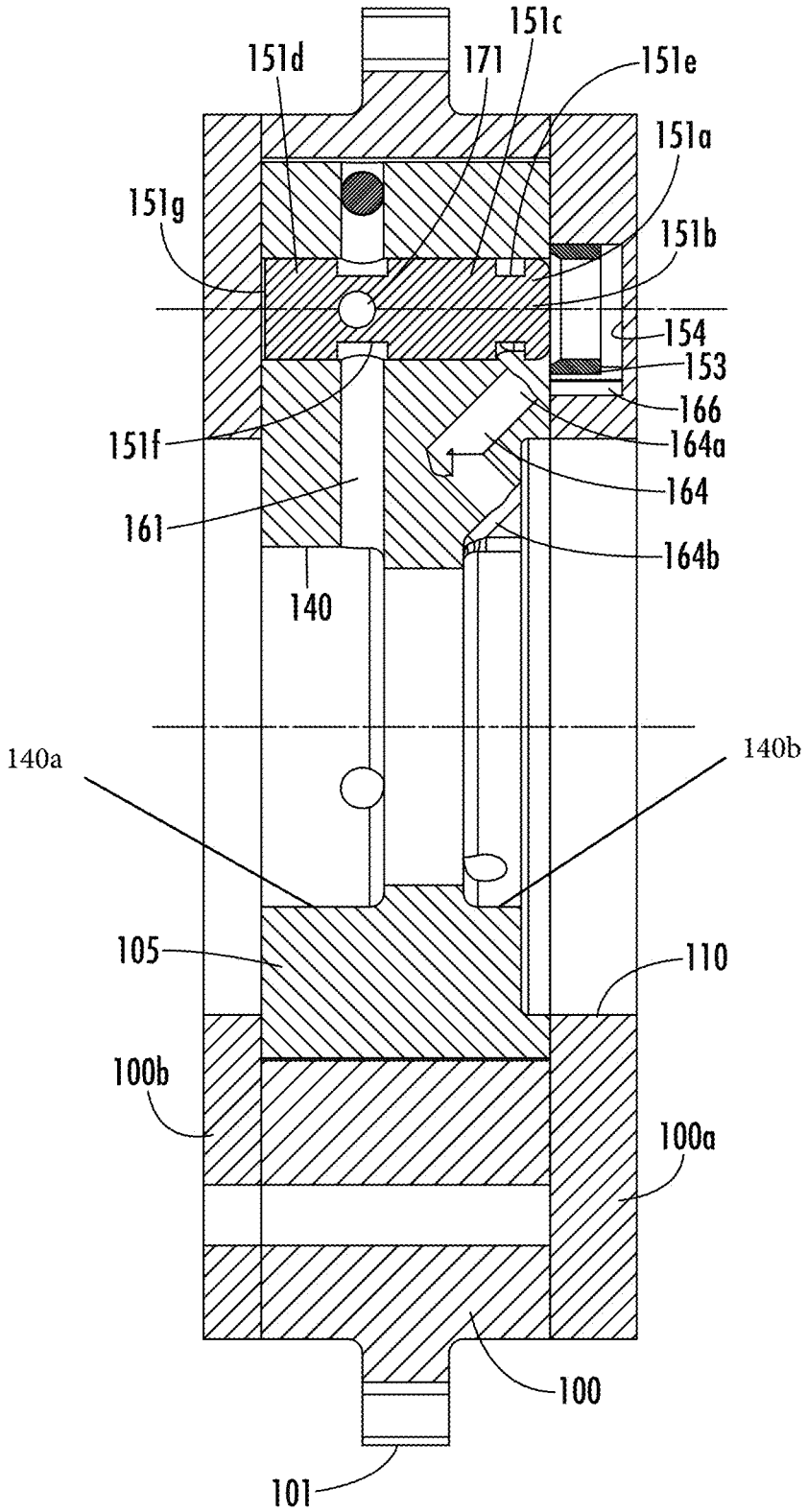
FIG. 4 shows a sectional view of the phaser of FIG. 3.

When the lock pin 150 is in the unlocked position as shown in FIGS. 3-4, the rotor assembly 105 can move relative to the housing assembly 100 and the first end 151*a* of the lock pin 150 is not received within the recess 154. In this position, fluid from advance chamber 102*a* can vent through the vane passage 171, through the second annulus 151*f* of the lock pin 150 to oil passage 161 and to vent through annulus 140*a* of the central bore 140.

To move from the unlocked position to the lock position, fluid is supplied from supply, through the annulus 140*a* of the central bore 140 to: an advance line 112 in the rotor assembly 105 connected to the advance chamber 102*b* and advance line 114, in the rotor assembly connected to the advance chamber 102*a*. Additionally, fluid is also supplied to the annulus 140*a* of the central bore 140, through oil passage 161, through vane passage 171 and into the advance chamber 102*a*. Fluid present in the advance chambers 102*a*, 102*b*, 102*c* rotationally move the vanes 104*a*-104*c* clockwise towards advance walls 107*a*, 107*b*, 107*c*. At the same time, fluid from the retard chambers 103*a*, 103*b*, 103*c* exits to a vent or sump.

More specifically, fluid from retard chamber 103*a* exits through the face passage 162 on the face 118 of the vane 104*a* to first lock pin annulus 151*e*, through the first end 164*a* of rotor passage 164, out the second end 164*b* to the annulus 140*b* of the central bore 140. Fluid from retard chamber 103*b* exits through retard line 113 to annulus 140*b* of the central bore 140 and fluid from retard chamber 103*c* exits through retard line 115 to annulus 140*b* of the central bore 140. Clockwise movement of the vanes 104*a*-104*c* rotates the vane 104*a* such that the first end 151*a* of the lock pin 150 moves towards and aligns with the recess 154 of the first end plate 100*a*. It is noted that the exhaustion of fluid from the retard chambers 103*a*-103*c* removes pressure on the first end 151*a* of the lock pin 150 causing the lock pin 150 to move toward the recess 154.

To move from the locked position to the unlocked position, fluid from supply is provided via the oil control valve to the annulus 140*b* of the central hole 140. From the annulus 140*b* of the central hole 140, fluid enters the second end 164*b* of the rotor passage, flows through rotor passage 164 and out of the first end 164*a* of the rotor passage. From the first end 164*a*, fluid flows through recess passage 166 and around the first end 151*a* of the lock pin 150 to move the lock pin 150 towards the second end plate 100*b*. Once the lock pin 152 is unlocked, such that the first end 151*a* us no longer engaged with the recess 154, fluid also flows from around the lock pin 150 via the lock pin annulus 151*e* to the face 118 of the vane 104*a* to face passage 162. From face passage 162, fluid flows to the retard chamber 103*a*. Fluid in the retard chamber 103*a* pushes the vane 104*a* towards the retard wall 106*a* moving counterclockwise. Fluid is additionally provided from the annulus 140*b* of the central bore 140 to the retard passages 113, 115 to retard chambers 103*b*, 103*c* respectively, moving vanes 104*b*, 104*c* towards retard walls 106*b*, 106*c*. At the same time, fluid present in the advance chamber 102*a* is vented through passage 171 of the lock pin 150 and between the second and third lands 151*c*, 151*d* through the second annulus 151*f* of the lock pin to oil passage 161 and to annulus 140*a* of the central bore 140 to vent to sump, for example through the oil control valve. Fluid additionally flows from the advance chambers 102*b*, 102*c* through advance lines 112, 114 to vent to the annulus 140*a* of the central bore 140.

Normal operation of advance and retarding the phaser occurs when the lock pin is in the unlocked position.

To move toward the advance position, fluid is supplied from supply (not shown), through the annulus 140*a* of the central bore 140 to: an advance line 112 in the rotor assembly 105 connected to the advance chamber 102*b* and advance line 114, in the rotor assembly connected to the advance chamber 102*a*. Additionally, fluid is also supplied to the annulus 140*a* of the central bore 140, through oil passage 161, through vane passage 171 and into the advance chamber 102*a*. Fluid present in the advance chambers 102*a*, 102*b*, 102*c* rotationally move the vanes 104*a*-104*c* clockwise towards advance walls 107*a*, 107*b*, 107*c*. At the same time, fluid from the retard chamber 103*a* exits through the face passage 162 on the face 118 of the vane 104*a* to recess passage 166, through rotor passage 164 out through the second end 164*b* to the central bore 140. Fluid from retard chamber 103*b* exits through retard line 113 to central bore 140 and fluid from retard chamber 103*c* exits through retard line 115 to central bore 140.

To move to the retard position, fluid from supply is provided via the oil control valve to the annulus 140*b* of the central hole 140. From the annulus 140*b* of the central hole 140, fluid enters the second end 164*b* of the rotor passage, flows through rotor passage 164 and out of the first end 164*a* of the rotor passage. From the first end 164*a*, fluid flows through recess passage 166 and around the first end 151*a* of the lock pin 150 via the lock pin annulus 151*e* to the face 118 of the vane 104*a* to face passage 162. From face passage 162, fluid flows to the retard chamber 103*a*. Fluid in the retard chamber 103*a* pushes the vane 104*a* towards the retard wall 106*a* moving counterclockwise. Fluid is additionally provided from the annulus 140*b* of the central bore 140 to the retard passages 113, 115 to retard chambers 103*b*, 103*c* respectively, moving vanes 104*b*, 104*c* towards retard walls 106*b*, 106*c*. At the same time, fluid present in the advance chamber 102*a* is vented through passage 171 of the lock pin 150 and between the second and third lands 151*c*, 151*d* through the second annulus 151*f* of the lock pin to oil passage 161 and to annulus 140*a* of the central bore 140 to vent to sump, for example through the oil control valve. Fluid additionally flows from the advance chambers 102*b*, 102*c* through advance lines 112, 114 to vent to the annulus 140*a* of the central bore 140.

FIGS. 5-8 show a second embodiment in which the lock pin is a stepped lock pin and eliminates the need for an annulus 151*e* on an outer diameter of the lock pin body 151 at the nose end 151*a*. In this embodiment, when the engine is shutdown, the phaser is commanded to the full advanced position and the lock pin 250 is locked.

The lock pin 250 has a body 251 with a first end 251*a* and a second end 251*f*. Between the first end 251*a* and the second end 251*f* is a nose 251*b*, a first land 251*c*, a first annulus 251*d*, and a second land 251*e*. In the locked position of the lock pin 250, the second land 251*e* blocks oil passage 161 and passage 171. In this embodiment, the first end 251*a* has a stepped diameter that engages with the recess 154 of the housing assembly 100.

The housing assembly 100 of the phaser has an outer circumference 101 for accepting drive force as well as a first end plate 100*a* and a second end plate 100*b*. The first end plate has a recess 154 for receiving a lock pin 250 and an inner diameter surface 110.

A rotor assembly 105 is coaxially located within the housing assembly 100 and is connected to the camshaft (not shown). A central bore 140 includes multiple annuli 140*a*, 140*b*. The central bore 140 is in fluid communication with an oil supply, a sump or exhaust, and multiple oil passages. In this embodiment, the oil control valve is shown as a remote oil control valve, remotely located from the phaser with multiple oil passages in fluid communication with annuli of the central bore 140.

The position of the oil control valve is controlled by an engine control unit (ECU) which controls the duty cycle of a variable force solenoid or other actuator. The ECU preferably includes a central processing unit (CPU) which runs various computational processes for controlling the engine, memory, and input and output ports used to exchange data with external devices and sensors.

Extending axially from the central hub 105*a* of the rotor assembly 105 are a plurality of vanes 104*a*-104*c* separating chambers 117*a*-117*c* formed between the housing assembly 100 and the rotor assembly 105 into advance chambers 102*a*-102*c* and retard chambers 103*a*-103*c*. Each of the chambers 117*a*-117*c* each have a retard wall 106*a*, 106*b*, 106*c* and a corresponding advance wall 107*a*, 107*b*, 107*c* which is separated by a distance. The vanes 104*a*-104*c* are capable of rotation to shift the relative angular position of the housing assembly 100 and the rotor assembly 105.

Advance passages 112, 114 are present between the central hub 105*a* of the rotor assembly 105, the advance chambers 102*b*, 102*c* and annulus 140*a*. Retard passages 113, 115 are present between the central hole 140 in the central hub 105*a* of the rotor assembly 105, the retard chambers 103*b*, 103*c* and annulus 140*b*.

At least one of the vanes 104*a* includes a bore 152 which receives a lock pin 250. The lock pin 250 has a body 251 with a first end 251*a* and a second end 251*f*. Between the first end 251*a* and the second end 251*f* is a nose 251*b*, a first land 251*c* and a second land 251*e*. Between the first land 251*c* and the second land 251*e* is a first annulus 251*d*.

Along the bore 152 in the vane 104*a* receiving the lock pin 250 is: a connection to an oil passage 161 in fluid communication with annulus 140*a* of the central bore 140, a vane passage 171 connected to the advance chamber 102*a*, a connection to a face passage 162 on the face 118 of the vane 104*a* adjacent the first end plate 100*a* and in communication with the retard chamber 103*a*, a rotor passage 164 with a first end 164*a* connected to a recess passage 164 and a second end 164*b* connected to the central bore 140. One or more of the face passage 162 or the rotor passage can be a restricted passage. The restricted passages 162 and 164 are preferably worm trails.

The lock pin 250 is moveable between an unlocked position and a locked position. In the locked position, the first end 251*a* and nose 251*b* engages with a recess 154 present in the first end plate 100*a*. A bushing 153 can be present in the recess 154 to more securely receive the first end 251*a* of the lock pin 250 in the locked position and define a recess passage 166 around the nose 251*b* of the lock pin 250 between the bushing 153 and the recess 154.

Figure 5:
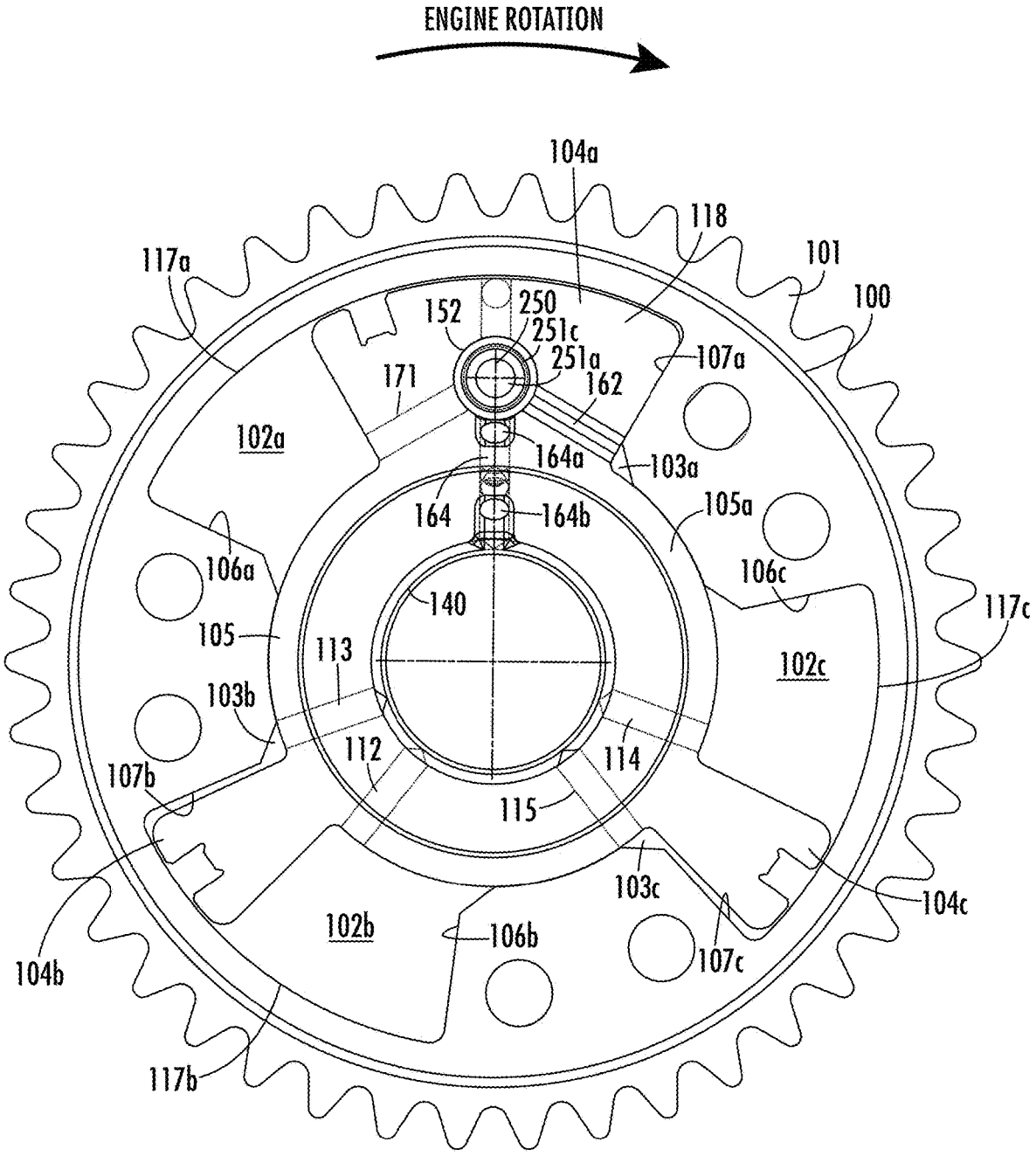
FIG. 5 shows a phaser of a second embodiment with the stepped lock pin in a locked position.
Figure 6:
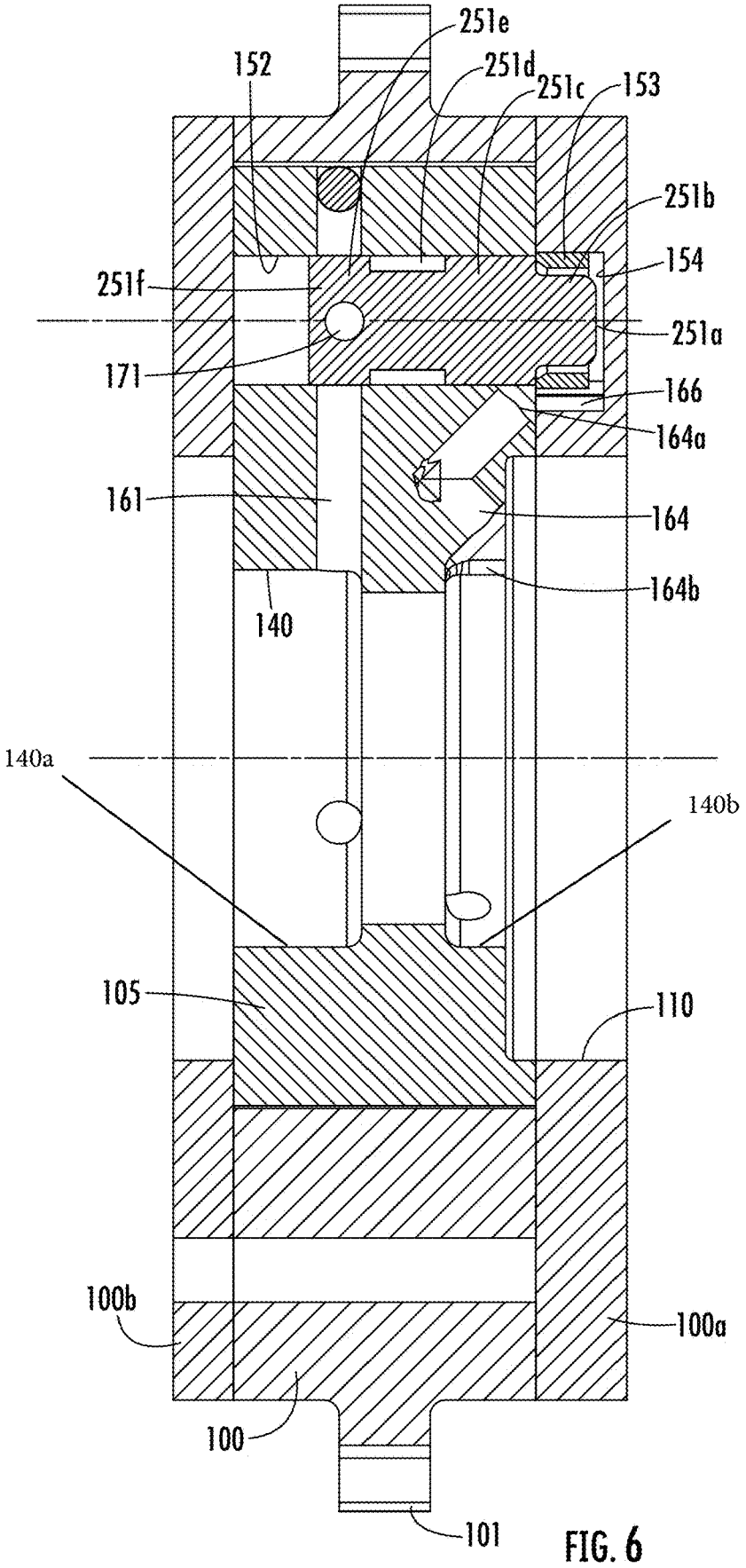
FIG. 6 shows a sectional view of the phaser of FIG. 5.

When the lock pin 250 is in the locked position as shown in FIGS. 5-6, the second land 251*e* blocks the flow of fluid from the advance chamber 102*a* by blocking both vane passage 171 and oil passage 161 leading to annulus 140*a* of the central bore 140, thereby preventing fluid from exiting the advance chamber 102*a*. With the lock pin 250 in the locked position, movement of the rotor assembly 105 relative to the housing assembly 100 is prevented. In this embodiment, the phaser is shown in the full advance position. The "full advance position" is defined as the position at which at least one vane 104*a*-104*c* contacts the retard wall 107*a*-107*c*.

Figure 7:
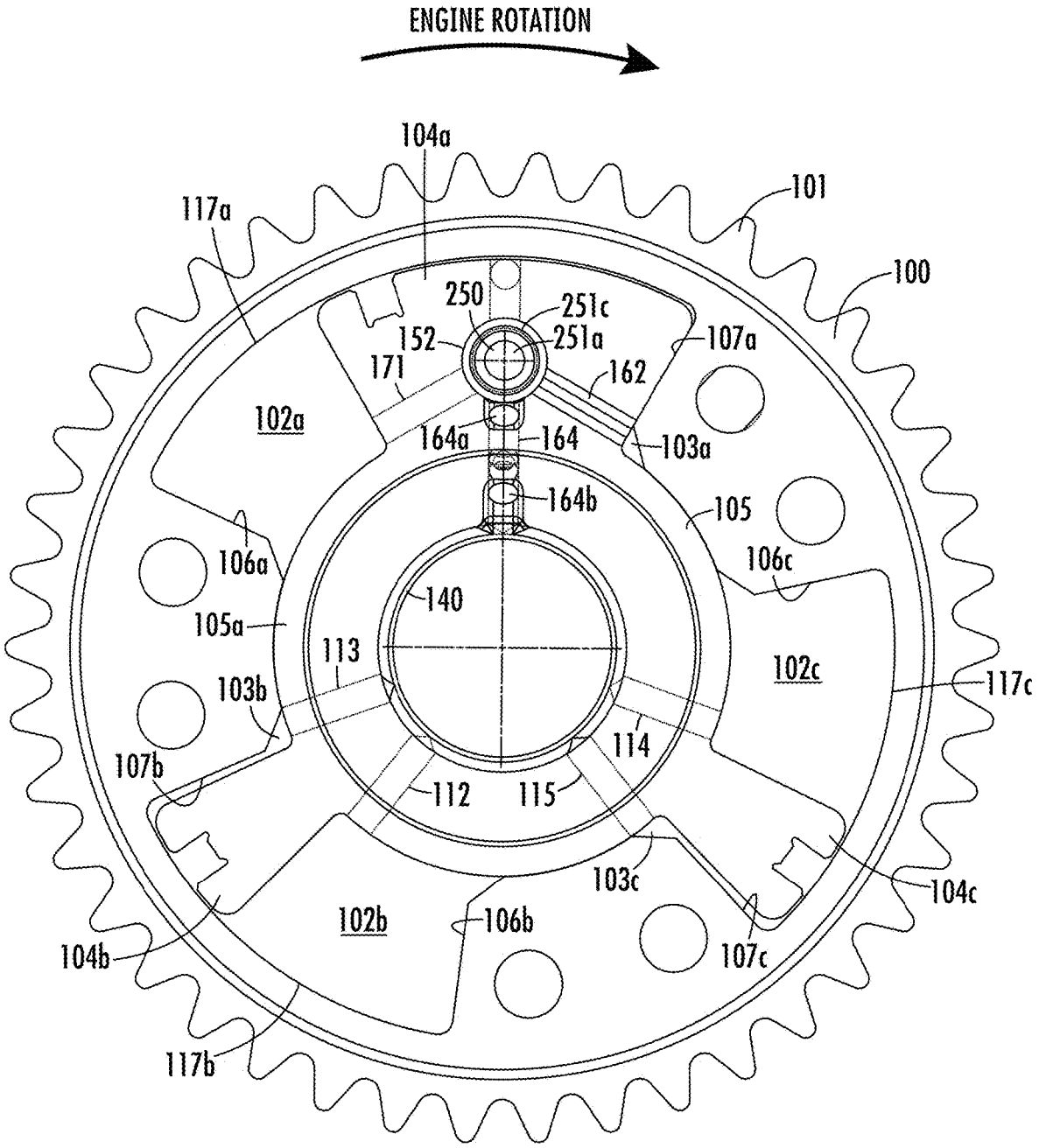
FIG. 7 shows the phaser of the second embodiment with the stepped lock pin in an unlocked position.
Figure 8:
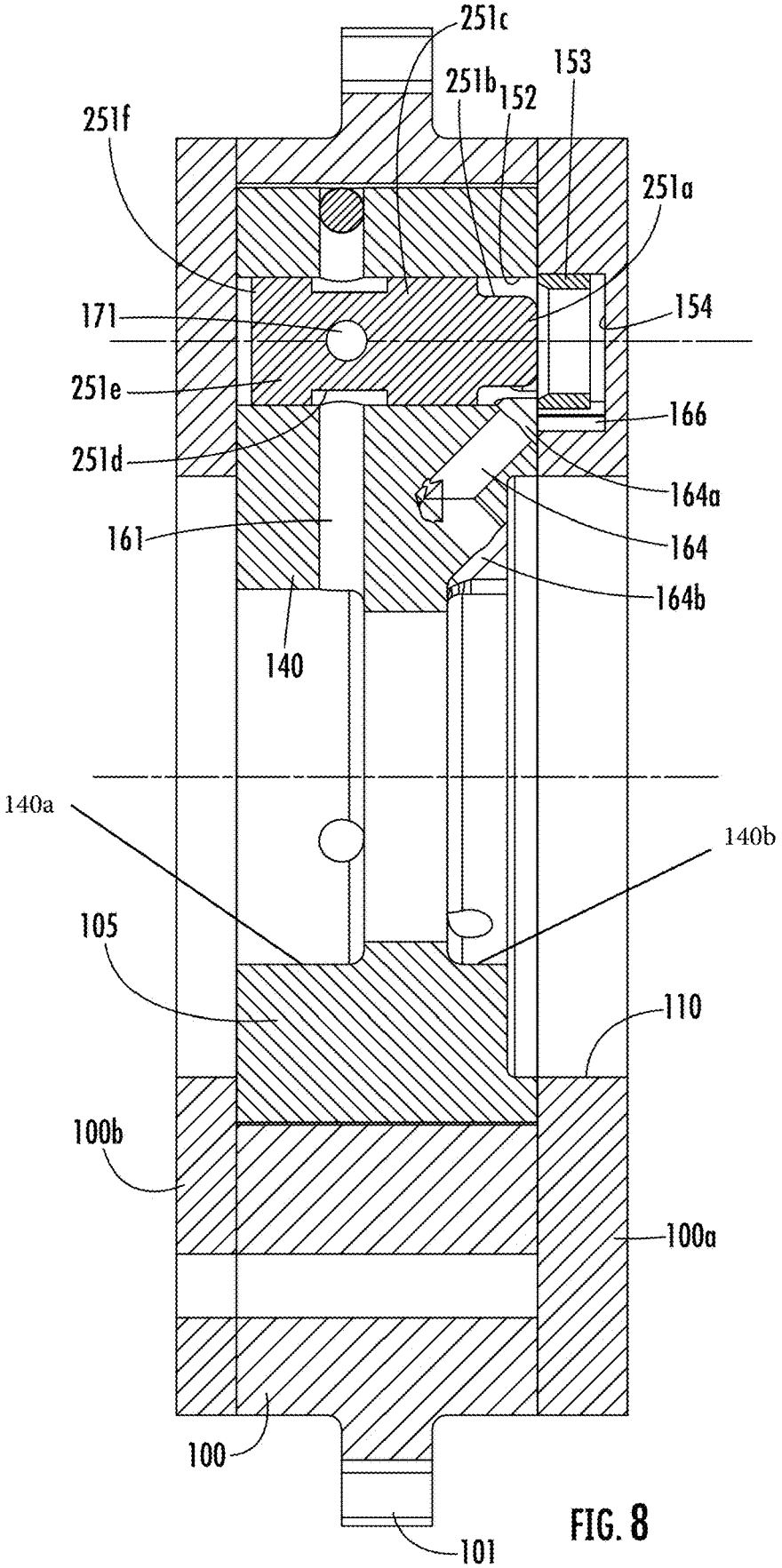
FIG. 8 shows a sectional view of the phaser of FIG. 7.

When the lock pin 250 is in the unlocked position as shown in FIGS. 7-8, the rotor assembly 105 can move relative to the housing assembly 100 and the first end 251*a* of the nose 251*b* of the lock pin 250 is not received within the recess 154. In this position, fluid from advance chamber 102*a* can vent through the vane passage 171, through the first annulus 251*d* of the lock pin 250 to oil passage 161 and to vent through annulus 140*a* of the central bore 140.

To move from the unlocked position to the lock position, fluid is supplied from supply, through the annulus 140*a* of the central bore 140 to: an advance line 112 in the rotor assembly 105 connected to the advance chamber 102*b* and advance line 114, in the rotor assembly connected to the advance chamber 102*c*. Additionally, fluid is also supplied to the annulus 140*a* of the central bore 140, through oil passage 161, through vane passage 171 and into the advance chamber 102*a*. Fluid present in the advance chambers 102*a*, 102*b*, 102*c* rotationally move the vanes 104*a*-104*c* clockwise towards advance walls 107*a*, 107*b*, 107*c*. At the same time, fluid from the retard chambers 103*a*, 103*b*, 103*c* exits to a vent or sump.

More specifically, fluid from retard chamber 103*a* exits through the face passage 162 on the face 118 of the vane 104*a* around the lock pin nose 251*b* to the first end 164*a* of the rotor passage 164, out the second end 164*b* of the rotor passage 164 to the annulus 140*b* of the central bore 140. Fluid from retard chamber 103*b* exits through retard line 113 to annulus 140*b* of the central bore 140 and fluid from retard chamber 103*c* exits through retard line 115 to annulus 140*b* of the central bore 140. Clockwise movement of the vanes 104*a*-104*c* rotates the vane 104*a* such that the first end 251*a* of the lock pin 250 moves towards and aligns with the recess 154 of the first end plate 100*a*. It is noted that the exhaustion of fluid from the retard chambers 103*a*-103*c* removes pressure on the first end 251*a* of the lock pin 250 causing the lock pin 250 to move toward the recess 154.

To move from the locked position to the unlocked position, fluid from supply is provided via the oil control valve to annulus 140*b* of the central hole 140. From annulus 140*b* of the central hole 140, fluid enters the second end 164*b* of the rotor passage 164, flows through rotor passage 164 and out of annulus 164*a*. From first end 164*a* of the rotor passage 164, fluid flows through recess passage 166 and around the nose 251*b* of the first end 251*a* of the lock pin 250 to move the lock pin 250 towards the second end plate 100*b*. Once the lock pin 250 is unlocked, such that the first end 251*a* is no longer within the recess 154, fluid also flows from around the lock pin nose 251*b* to the face 118 of the vane 104*a* to face passage 162. From face passage 162, fluid flows to the retard chamber 103*a*. Fluid in the retard chamber 103*a* pushes the vane 104*a* towards the advance wall 106*a* moving counterclockwise. Fluid is additionally provided from the annulus 140*b* of the central bore 140 to the retard passages 113, 115 to retard chambers 103*b*, 103*c* respectively, moving vanes 104*b*, 104*c* towards retard walls 106*b*, 106*c*. At the same time, fluid present in the advance chamber 102*a* is vented through the lock pin 250 between the first and second lands 251*c*, 251*e* through the first annulus 251*d* and through passage 171 to oil passage 161 and to annulus 140*a* of the central bore 140 to vent to sump, for example through the oil control valve. Fluid additionally flows from the advance chambers 102*b*, 102*c* through advance lines 112, 114 to vent to the annulus 140*a* of the central bore 140.

Normal operation of advance and retarding the phaser occurs when the lock pin is in the unlocked position.

To move toward the advance position, fluid is supplied from supply, through the annulus 140*a* of the central bore 140 to: an advance line 112 in the rotor assembly 105 connected to the advance chamber 102*b* and advance line 114, in the rotor assembly connected to the advance chamber 102*c*. Additionally, fluid is also supplied to the annulus 140*a* of the central bore 140, through oil passage 161, through vane passage 171 and into the advance chamber 102*a*. Fluid present in the advance chambers 102*a*, 102*b*, 102*c* rotationally move the vanes 104*a*-104*c* clockwise towards advance walls 107*a*, 107*b*, 107*c*. At the same time, fluid from the retard chambers 103*a*, 103*b*, 103*c* exits to a vent or sump. Fluid from retard chamber 103*a* exits through the face passage 162 on the face 118 of the vane 104*a* to recess annulus 166, through rotor passage 164, out to the central bore 140. Fluid from retard chamber 103*b* exits through retard line 113 to central bore 140 and fluid from retard chamber 103*c* exits through retard line 115 to central bore 140.

To move to the retard position, fluid from supply is provided via the oil control valve to annulus 140*b* of the central hole 140. From annulus 140*b* of the central hole 140, fluid enters the second end 164*b* of the rotor passage 164, flows through rotor passage 164 and out of annulus 164*a*. From first end 164*a* of the rotor passage 164, fluid flows through recess passage 166 and around the nose 251*b* of the first end 251*a* of the lock pin to the face 118 of the vane 104*a* to face passage 162. From face passage 162, fluid flows to the retard chamber 103*a*. Fluid in the retard chamber 103*a* pushes the vane 104*a* towards the advance wall 106*a* moving counterclockwise. Fluid is additionally provided from the annulus 140*b* of the central bore 140 to the retard passages 113, 115 to retard chambers 103*b*, 103*c* respectively, moving vanes 104*b*, 104*c* towards retard walls 106*b*, 106*c*. At the same time, fluid present in the advance chamber 102*a* is vented through the lock pin 250 between the first and second lands 251*c*, 251*e* through the first annulus 251*d* and through passage 171 to oil passage 161 and to annulus 140*a* of the central bore 140 to vent to sump, for example through the oil control valve. Fluid from advance chamber 102*b* exits to the central bore 140 and to sump through advance line 112 and fluid exits from advance chamber 102*c* to the central bore 140 and to sump through advance line 114. Fluid from advance chamber 102*a* exits through vane passage 171, through the first annulus 251*d* of the lock pin 250 between the first and second lands 251*c*, 251*e* to oil passage 161 and the central bore 140.

Figure 11:
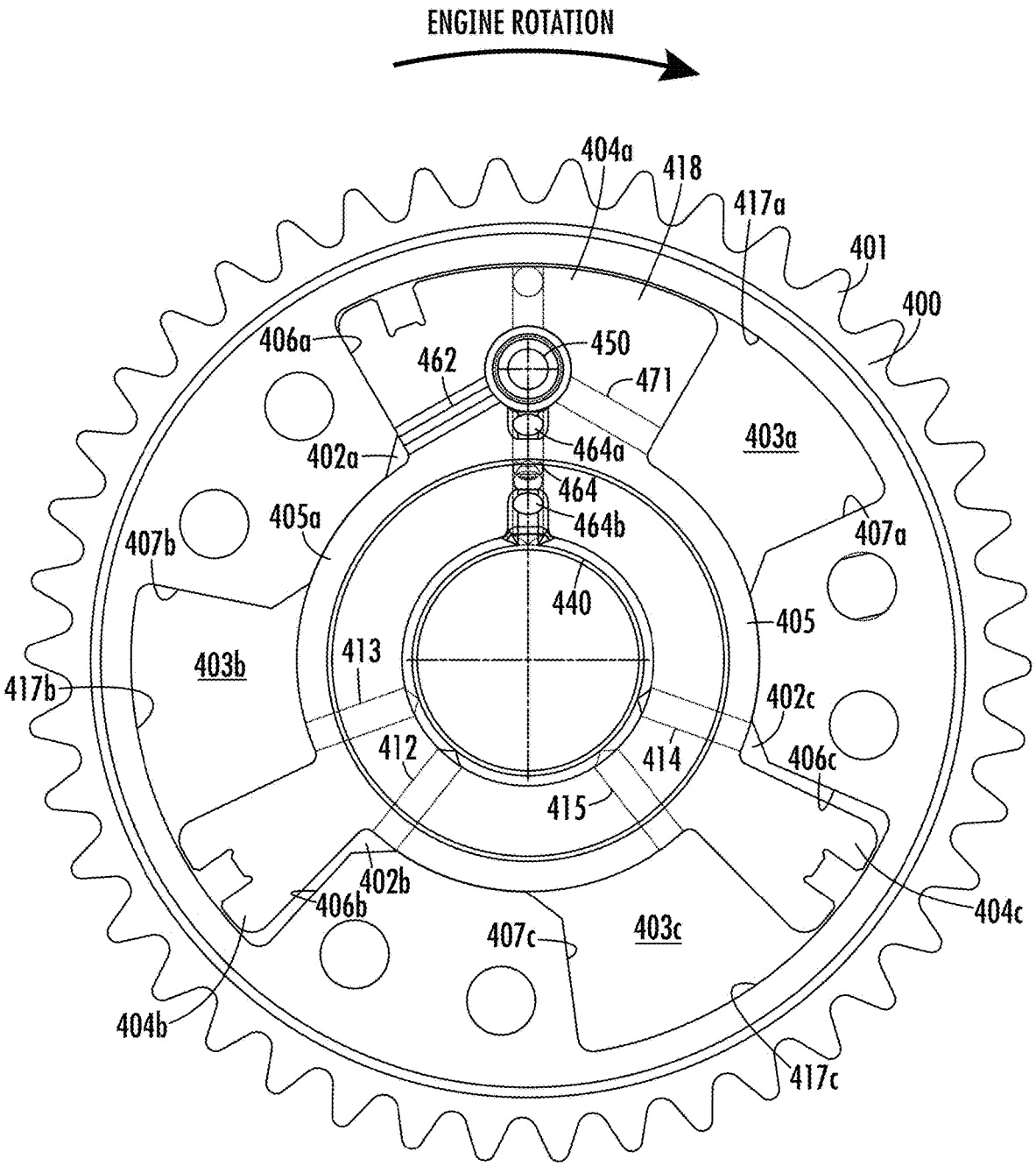
FIG. 11 shows a phaser of with a lock pin connected to multiple advance and retard chambers in a locked position
Figure 12:
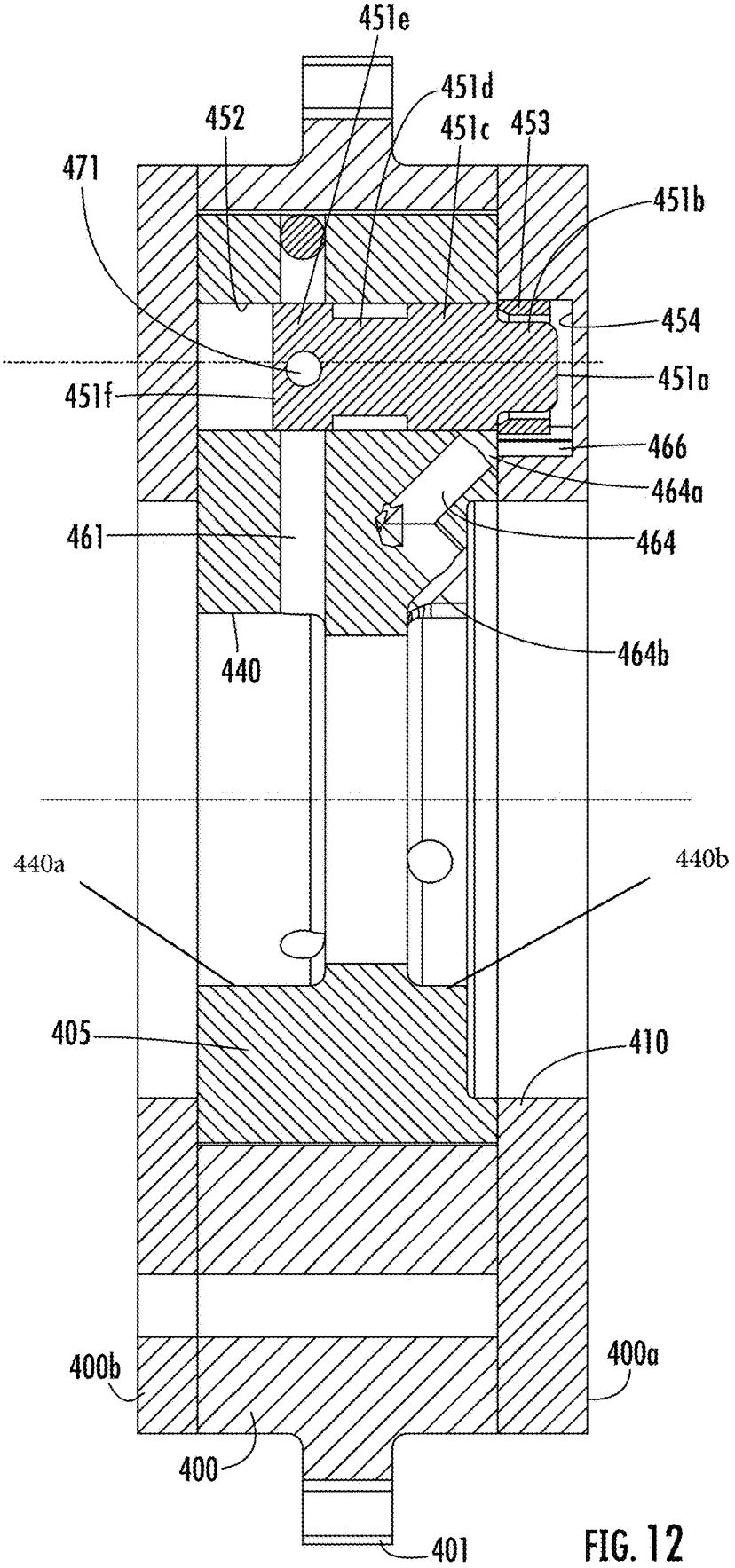
FIG. 12 shows a sectional view of the phaser of FIG. 11.

While the above embodiments are discussed with the phaser being present in the full advance position at engine shutdown, the phaser can alternatively be placed in the full retard position at engine shutdown. FIGS. 11-12 show a third embodiment with the phaser locked in the full retard position, with the face passage 462 on the face 418 of the vane 404*a* connecting the advance chamber 402*a* to the lock pin bore 452. Fluid is prevented from exhausting from the retard chamber 403*a* via passages 461, 471 by the second land 451*e* the lock pin 450.

The housing assembly 400 of the phaser has an outer circumference 401 for accepting drive force as well as a first end plate 400*a* and a second end plate 400*b*. The first end plate has a recess 454 for receiving a lock pin 450 and a cam bearing surface 410.

A rotor assembly 405 is coaxially located within the housing assembly 400 and is connected to the camshaft (not shown). A central bore 440 defines multiple annuli 440*a*, 440*b*. The central bore 440 is in fluid communication with an oil supply, a sump or exhaust, and multiple oil passages. In this embodiment, the oil control valve is shown as a remote oil control valve is shown as a remote oil control valve, remotely located from the phaser with multiple oil passages in fluid communication with annuli of the central bore 440. In an alternate embodiment, the oil control valve can also be center mounted within the phaser or center mounted as part of a center bolt assembly.

The position of the oil control valve is controlled by an engine control unit (ECU) which controls the duty cycle of a variable force solenoid or other actuator. The ECU preferably includes a central processing unit (CPU) which runs various computational processes for controlling the engine, memory, and input and output ports used to exchange data with external devices and sensors.

Extending axially from the central hub 405*a* of the rotor assembly 405 are a plurality of vanes 404*a*-404*c* separating chambers 417*a*-417*c* formed between the housing assembly 400 and the rotor assembly 405 into advance chambers 402*a*-402*c* and retard chambers 403*a*-403*c*. Each of the chambers 417*a*-417*c* each have a retard wall 406*a*, 406*b*, 406*c* and a corresponding advance wall 407*a*, 407*b*, 407*c* which is separated by a distance. The vanes 404*a*-404*c* are capable of rotation to shift the relative angular position of the housing assembly 400 and the rotor assembly 405.

Advance passages 412, 414 are present between the central hub 405*a* of the rotor assembly 405 and the advance chambers 402*b*, 402*c* and annulus 440*b* of the central bore 440. Retard passages 413, 415 are present between the central hub 405*a* of the rotor assembly 405 and the retard chambers 403*b*, 403*c* and annulus 440*a* of the central bore 440.

At least one of the vanes 404*a* includes a bore 452 which receives a lock pin 450. The lock pin 450 has a body 451 with a first end 451*a* and a second end 451*f*. Between the first end 451*a* and the second end 451*f* is a nose 451*b*, a first land 451*c* and a second land 451*e*. Between the first land 451*c* and the second land 451*e* is a first annulus 451*d*.

Along the bore 452 in the vane 404*a* receiving the lock pin 450 is: a connection to an oil passage 461 in fluid communication with annulus 440*a* of the central bore 440, a vane passage 471 connected to the retard chamber 403*a*, a connection to a face passage 462 on the face 418 of the vane 404*a* adjacent the outer plate 400*a* and in communication with the advance chamber 402*a*, a passage 464 connected to the central bore 440. The passage 464 connects the second end 451*f* of the lock pin 450 to the annulus 440*b*. In one embodiment, the passages 462 and 464 are restricted. The passages 462, 464 are preferably worm trails.

The lock pin 450 is moveable between an unlocked position and a locked position. In the locked position, the first end 451*a* and nose 451*b* engages with a recess 454 present in the first end plate 400*a*. A bushing 453 can be present in the recess 454 to more securely receive the first end 451*a* of the lock pin 450 in the locked position and define a recess passage 466 around the nose 451*b* of the lock pin 450 between the bushing 453 and the recess 454.

When the lock pin 450 is in the locked position as shown in FIGS. 11-12, the second land 451*e* blocks the flow of fluid from the retard chamber 403*a* by blocking both vane passage 471 and oil passage 461 leading to annulus 440*a*, thereby preventing fluid from exiting the retard chamber 403*a*. With the lock pin 450 in the locked position, movement of the rotor assembly 405 relative to the housing assembly 400 is prevented. In this embodiment, the phaser is preferably in the full retard position. The "full retard position" is defined as the position at which at least one vane 404*a*-404*c* contacts the retard wall 406*a*-406*c*.

When the lock pin 450 is in the unlocked position, the rotor assembly 405 can move relative to the housing assembly 400 and the first end 451*a* of the nose 451*b* of the lock pin 450 is not received within the recess 454. In this position, fluid from retard chamber 403*a* can vent through the vane passage 471, through the first annulus 451*d* of the lock pin 450 to oil passage 461 and to vent through annulus 440*a* of the central bore 440.

To move from the unlocked position to the lock position, fluid is supplied from supply, through the annulus 440*a* of the central bore 440 to: a retard line 413 in the rotor assembly 405 connected to the retard chamber 403*b* and retard line 415, in the rotor assembly 405 connected to the retard chamber 403*c*. Additionally, fluid is also supplied to the annulus 440*a* of the central bore 440, through oil passage 461, through vane passage 471 and into the retard chamber 403*a*.

Fluid present in the retard chambers 403*a*, 403*b*, 403*c* rotationally move the vanes 404*a*-404*c* counter clockwise towards advance walls 406*a*, 406*b*, 406*c*. At the same time, fluid from the advance chambers 402*a*, 402*b*, 402*c* exits to a vent or sump. More specifically, fluid from advance chamber 402*a* exits through the passage 462 on the face 418 of the vane 404*a*, around the nose 451*b* of the lock pin 450 to first end 464*a* of the passage 464, out through the second end 464*b* of the passage 464 to the annulus 440*b* of the central bore 440. Fluid from advance chamber 402*b* exits through advance line 412 to annulus 440*b* and fluid from advance chamber 402*c* exits through advance line 414 to annulus 440*b* of the central bore 440. Anti-clockwise movement of the vanes 404*a*-404*c* rotates the vane 404*a* such that the first end 451*a* of the lock pin 450 moves towards and aligns with the recess 454 of the outer plate 400*a*. It is noted that the exhaustion of fluid from the advance chambers 402*a*-402*c* removes pressure on the first end 451*a* of the lock pin 450 causing the lock pin 450 to move toward the recess 454.

To move from the locked position to the unlocked position, fluid from supply is provided via the oil control valve to the annulus 440*b* of the central bore 440. From the annulus 440*b* of the central bore 440, fluid enters the second end 464*b* of rotor passage 464, flows through rotor passage 464 and out of the first end 464*a* of the rotor passage 464. From first end 464*a* of the rotor passage 464, fluid flows through recess annulus 466 and around the nose 451*b* of the first end 451*a* of the lock pin 450 to move the lock pin 450 towards the second outer plate 400*b*. Once the lock pin 450 is unlocked or moved so that the first end 451*a* no longer engages with the recess 454 of the outer end plate 400*a*, fluid also flows from around the lock pin nose 451*b* to the face 418 of the vane 404*a* to face passage 462. From face passage 462, fluid flows to the advance chamber 402*a*. Fluid in the advance chamber 402*a* pushes the vane 404*a* towards the advance wall 407*a*, moving clockwise. Fluid is additionally provided from the annulus 440*b* of the central bore 440 to the advance passages 412, 414 to advance chambers 402*b*, 402*c* respectively, moving vanes 404*b*, 404*c* towards advance walls 407*b*, 407*c*. At the same time, fluid present in the retard chamber 403*a* is vented through passage 471, the lock pin 450 between the first and second lands 451*c*, 451*e* through the first annulus 451*d* to line 461 and to the annulus 440*a* of the central bore 440 to vent to sump, for example through the oil control valve. Fluid additionally flows from the retard chambers 403*b*, 403*c* through advance lines 413, 415 to vent to the annulus 440*a* of the central bore 440.

Normal operation of advance and retarding the phaser occurs when the lock pin is in the unlocked position.

To move toward the retard position, fluid is provided from supply (not shown) to the annulus 440*a* of the central bore 440 to: a retard line 413 in the rotor assembly 405 connected to the retard chamber 403*b* and retard line 415, in the rotor assembly 405 connected to the retard chamber 403*c*. Additionally, fluid is also supplied to the annulus 440*a* of the central bore 440, through oil passage 461, through vane passage 471 and into the retard chamber 403*a*. Fluid present in the retard chambers 403*a*, 403*b*, 403*c* rotationally move the vanes 404*a*-404*c* counter clockwise towards advance walls 406*a*, 406*b*, 406*c*. At the same time, fluid from the advance chambers 402*a*, 402*b*, 402*c* exits to a vent or sump. More specifically, fluid from advance chamber 402*a* exits through the passage 462 on the face 418 of the vane 404*a*, around the nose 451*b* of the lock pin 450 to first end 464*a* of the passage 464, out through the second end 464*b* of the passage 464 to the annulus 440*b* of the central bore 440. Fluid from advance chamber 402*b* exits through advance line 412 to annulus 440*b* and fluid from advance chamber 402*c* exits through advance line 414 to annulus 440*b* of the central bore 440.

To move to the advance position, fluid from supply is provided via the oil control valve to the annulus 440*b* of the central bore 440. From the annulus 440*b* of the central bore 440, fluid enters the second end 464*b* of rotor passage 464, flows through rotor passage 464 and out of the first end 464*a* of the rotor passage 464. From first end 464*a* of the rotor passage 464, fluid flows through recess annulus 466 and around the nose 451*b* of the first end 451*a* of the lock pin 450 to the face 418 of the vane 404*a* to face passage 462. From face passage 462, fluid flows to the advance chamber 402*a*. Fluid in the advance chamber 402*a* pushes the vane 404*a* towards the advance wall 407*a*, moving clockwise. Fluid is additionally provided from the annulus 440*b* of the central bore 440 to the advance passages 412, 414 to advance chambers 402*b*, 402*c* respectively, moving vanes 404*b*, 404*c* towards advance walls 407*b*, 407*c*. At the same time, fluid present in the retard chamber 403*a* is vented through passage 471, the lock pin 450 between the first and second lands 451*c*, 451*e* through the first annulus 451*d* to line 461 and to the annulus 440*a* of the central bore 440 to vent to sump, for example through the oil control valve. Fluid additionally flows from the retard chambers 403*b*, 403*c* through advance lines 413, 415 to vent to the annulus 440*a* of the central bore 440.

Figure 9:
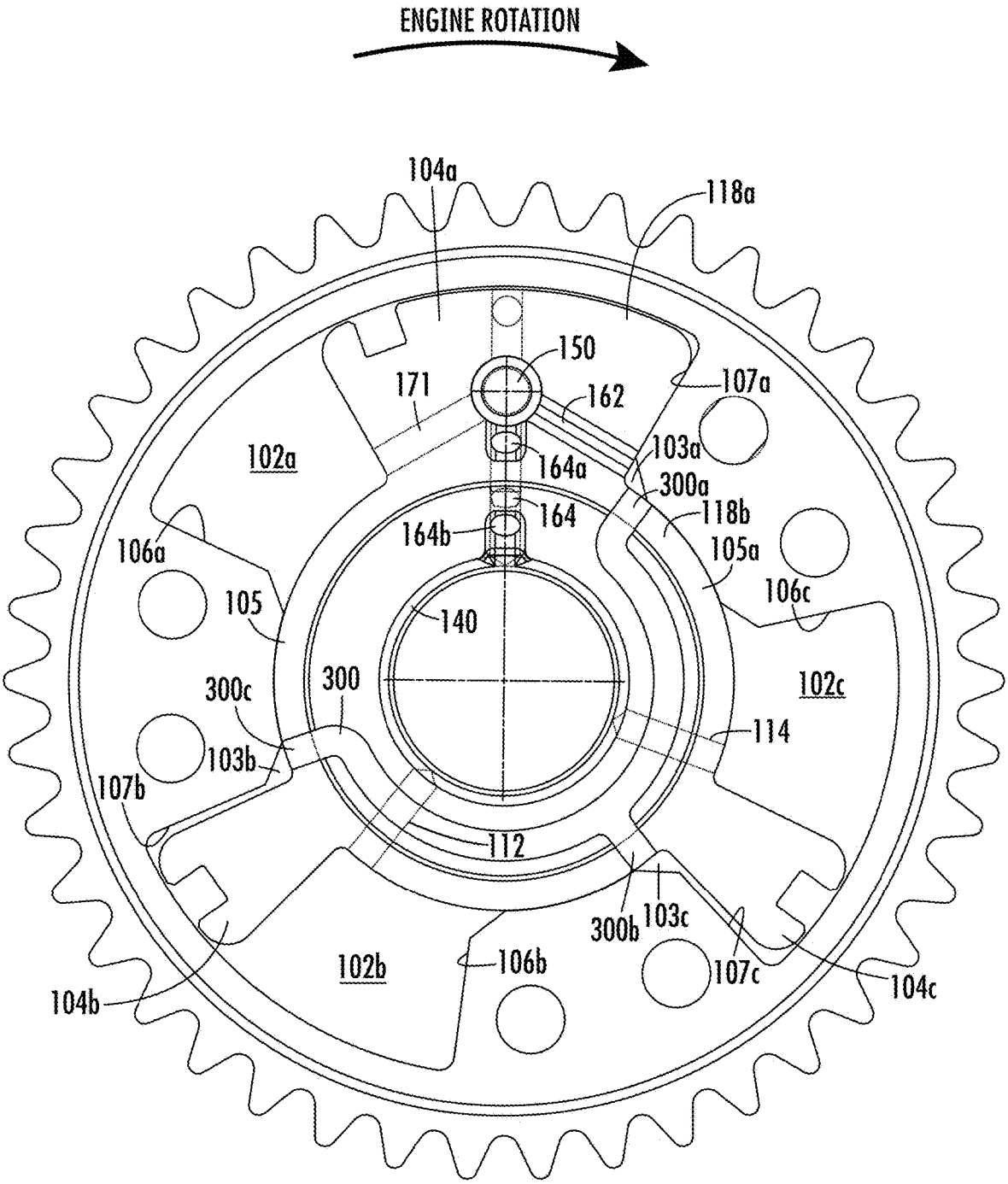
FIG. 9 shows a phaser in which the worm trail on the face on the vane is connected to the advance chamber and the lock pin.
Figure 10:
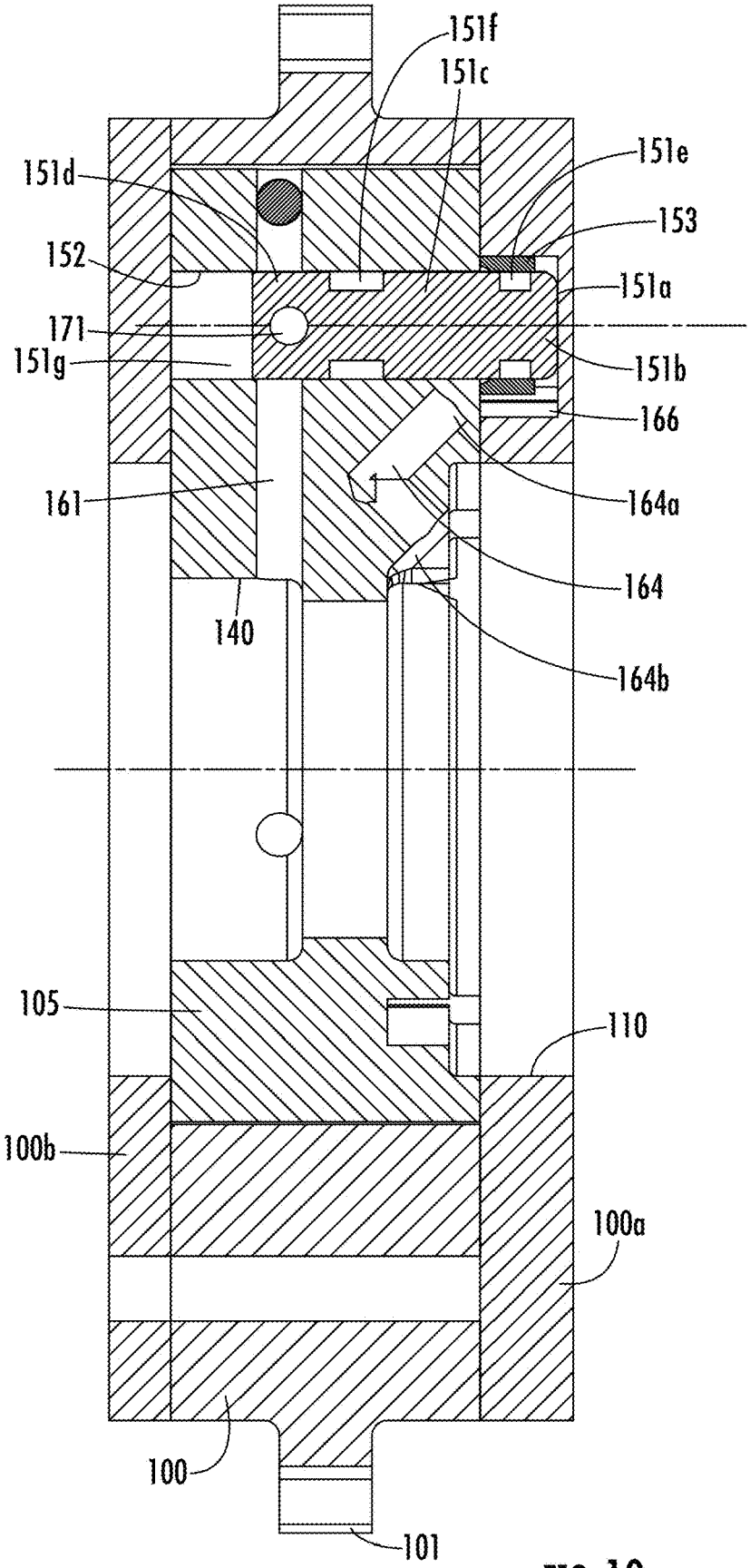
FIG. 10 shows a sectional view of the phaser of FIG. 9.

While the lock pin 450 shown in FIGS. 9-10 has a single annulus 451*d*, the lock pin 450 can be replaced with lock pin 150 with two annuli 151*e*, 151*f*, such that fluid can flow through the second annulus 151*f* to line 461, and annuli 151*e* to rotor passage 464.

A control valve can be received directly within the central bore 440 of the rotor assembly 405 or within a sleeve which is received within the central bore 440 of the rotor assembly 405.

FIGS. 9-10 show another embodiment for an advance locked phaser in which all of the retard chambers are connected by a single passage on the face of the vane. This embodiment is a variation of the first embodiment shown in FIGS. 1-2 where retard lines 113, 115 in fluid connection with retard chambers 103*b*, 103*c* respectively, are replaced by a single face passage 300 which has three ports. A first port 300*a* of the single face passage 300 is in communication with retard chamber 103*a*, a second port 300*b* of the single face passage 300 is in communication with retard chamber 103*b*, and a third port 300*c* of the single face passage 300 is in communication with retard chamber 103*c*. The single face passage 300 thereby connects retard chambers 103*a*, 103*b* and 103*c* to each other.

It is noted that in the first embodiment shown in FIGS. 1-2, when trying to unlock the lock pin 150 the oil pressure torque generated on vane 104*a* is eliminated until the lock pin 150 is moved to the unlock position. This reduces the side load on the lock pin 150 during unlocking compared to conventional systems. In the embodiment shown in FIGS. 9-10, when trying to unlock the lock pin 150, the oil pressure torque on all vanes 104*a*-104*c* is eliminated. This prevents any side loading of the lock pin 150 during unlocking which is an advantage over conventional systems and provides additional benefits over the first embodiment.

To move from the unlocked position to the lock position, fluid is supplied from supply, through the annulus 140*a* of the central bore 140 to: an advance line 112 in the rotor assembly 105 connected to the advance chamber 102*b* and advance line 114, in the rotor assembly connected to the advance chamber 102*c*. Additionally, fluid is also supplied to the annulus 140*a* of the central bore 140, through oil passage 161, through vane passage 171 and into the advance chamber 102*a*. Fluid present in the advance chambers 102*a*, 102*b*, 102*c* rotationally move the vanes 104*a*-104*c* clockwise towards advance walls 107*a*, 107*b*, 107*c*. At the same time, fluid from the retard chambers 103*a*, 103*b*, 103*c* exits to a vent or sump.

More specifically, fluid from retard chamber 103*a* exits through the face passage 162 on the face 118 of the vane 104*a* to the first lock pin annulus 151*e* through the first end 164*a* of passage 164 and through the second end of passage 164 to the annulus 140*b* of the central bore 140. Fluid from retard chamber 103*b* exits through port 300*b* to single face passage 300 and fluid from retard chamber 103*c* exits through port 300*c* to the single face passage 300. From the single face passage 300, fluid flows to the retard chamber 103*a* via port 300*a*. Clockwise movement of the vanes 104*a*-104*c* rotates the vane 104*a* such that the first end 151*a* of the lock pin 150 moves towards and aligns with the recess 154 of the first end plate 100*a*. It is noted that the exhaustion of fluid from the retard chambers 103*a*-103*c* removes pressure on the first end 151*a* of the lock pin 150 causing the lock pin 150 to move toward the recess 154.

To move from the locked position to the unlocked position, fluid from supply is provided via the oil control valve to annulus 140*b* of the central hole 140. From annulus 140*b* of the central hole 140, fluid enters the second end 164*b* of the rotor passage 164, flows through rotor passage 164 and out of annulus 164*a*. From first end 164*a* of the rotor passage 164, fluid flows through recess passage 166 and around the nose 151*b* of the first end 151*a* of the lock pin 150 to move the lock pin 150 towards the second end plate 100*b*. Once the lock pin 150 is unlocked, such that the first end 151*a* is no longer within the recess 154, fluid also flows from around the lock pin nose 151*b* to the face 118 of the vane 104*a* to face passage 162. From face passage 162, fluid flows to the retard chamber 103*a*. Fluid in the retard chamber 103*a* pushes the vane 104*a* towards the advance wall 106*a* moving counterclockwise. Fluid is also provided to the retard chambers 103*b*, 103*c* via retard chamber 103*a*. Specifically, fluid from retard chamber 103*a* via port 300*a* and the face passage can provide fluid to retard chambers 103*b* via port 300*b* and to retard chamber 103*c* via port 300*c*, thereby moving vanes 104*b*, 104*c* towards retard walls 106*b*, 106*c*. At the same time, fluid present in the advance chamber 102*a* is vented through the lock pin 150 between the second and third lands 151*c*, 151*d* through the second annulus 151*f* to oil passage 161 and to the annulus 140*a* of the central bore 140 to vent to sump, for example through the oil control valve. Fluid additionally flows from the advance chambers 102*b*, 102*c* through advance lines 112, 114 to vent to the annulus 140*a* of the central bore 140.

Normal operation of advance and retarding the phaser occurs when the lock pin is in the unlocked position.

To move toward the advance position, fluid is supplied from supply, through the annulus 140*a* of the central bore 140 to: an advance line 112 in the rotor assembly 105 connected to the advance chamber 102*b* and advance line 114, in the rotor assembly connected to the advance chamber 102*c*. Additionally, fluid is also supplied to the annulus 140*a* of the central bore 140, through oil passage 161, through vane passage 171 and into the advance chamber 102*a*. Fluid present in the advance chambers 102*a*, 102*b*, 102*c* rotationally move the vanes 104*a*-104*c* clockwise towards advance walls 107*a*, 107*b*, 107*c*. At the same time, fluid from the retard chambers 103*a*, 103*b*, 103*c* exits to a vent or sump.

More specifically, fluid from retard chamber 103*a* exits through the face passage 162 on the face 118 of the vane 104*a* to the first lock pin annulus 151*e* through the first end 164*a* of passage 164 and through the second end of passage 164 to the annulus 140*b* of the central bore 140. Fluid from retard chamber 103*b* exits through port 300*b* to single face passage 300 and fluid from retard chamber 103*c* exits through port 300*c* to the single face passage 300. From the single face passage 300, fluid flows to the retard chamber 103*a* via port 300*a*.

To move to the retard position, fluid from supply is provided via the oil control valve to annulus 140*b* of the central hole 140. From annulus 140*b* of the central hole 140, fluid enters the second end 164*b* of the rotor passage 164, flows through rotor passage 164 and out of annulus 164*a*. From first end 164*a* of the rotor passage 164, fluid flows through recess passage 166 and around the nose 151*b* of the first end 151*a* of the lock pin 150 to the face 118 of the vane 104*a* to face passage 162. From face passage 162, fluid flows to the retard chamber 103*a*. Fluid in the retard chamber 103*a* pushes the vane 104*a* towards the advance wall 106*a* moving counterclockwise. Fluid is also provided to the retard chambers 103*b*, 103*c* via retard chamber 103*a*. Specifically, fluid from retard chamber 103*a* via port 300*a* and the face passage can provide fluid to retard chambers 103*b* via port 300*b* and to retard chamber 103*c* via port 300*c*, thereby moving vanes 104*b*, 104*c* towards retard walls 106*b*, 106*c*. At the same time, fluid present in the advance chamber 102*a* is vented through the lock pin 150 between the second and third lands 151*c*, 151*d* through the second annulus 151*f* to oil passage 161 and to the annulus 140*a* of the central bore 140 to vent to sump, for example through the oil control valve. Fluid additionally flows from the advance chambers 102*b*, 102*c* through advance lines 112, 114 to vent to the annulus 140*a* of the central bore 140.

While the movement of the phaser has been described as oil pressure actuated, a check valve can be added between a supply and the oil control valve, such that the phaser operates under torsion assist.

It is also noted that while the bore within the body of the rotor of the rotor assembly is described as being a central bore, it is within the scope of the invention to have the bore located in an area other than a center of the rotor assembly.

While there are advantages to including both the vane passage 171, 471 and the face passage 162, 462, such as an increase in the fluid retained within the chambers, there are applications in which the fluid may need to be retained in only of the advance or retard chambers. In another embodiment, vane passage 171, 471 could be removed and replaced with a radial hole to provide pressurized fluid to the associated connected advance or retard chamber while still maintaining fluid within the other advance or retard chamber. This can be accomplished since the vane passage 171, 471 and face passage 162, 462 operate independently. It is also noted that if only the face passage 162, 462 were present (vane passage 171, 471 removed), the face passage 162, 462 is placed on the vane such that the face passage 162, 462 is in fluid connection with the chamber closest to the direction in which the phaser is locking. In other words, the face passage 162, 462 is in fluid connection with the advance chamber 102*a*, 402*a* if the phaser is locking in the full retard position (vane 104*a*, 404*a* adjacent the wall 106*a*, 406*a* of the advance chamber 102*a*, 402*a*). The face passage 162, 462 would be in fluid connection with the retard chamber 103*a*, 403*a* if the phaser is locking in the full advance position (vane 104*a*, 404*a* adjacent the wall 107*a*, 407*a* of the retard chamber 103*a*, 403*a*).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser comprising:

a housing assembly having an outer circumference for accepting drive force;

a rotor assembly connected to a camshaft, the rotor assembly coaxially located within the housing assembly, at least one chamber defined by the housing assembly and the rotor assembly, the rotor assembly comprising: a rotor body defining a bore and having at least a first vane extending therefrom, the at least first vane of the rotor assembly received within the at least one chamber, separating the at least one chamber into at least one advance chamber and at least one retard chamber, the at least first vane defining a lock pin bore, the at least first vane within the at least one chamber acting to shift relative angular position of the housing assembly and the rotor assembly;

a lock pin having a body comprising a first end and a second end, the lock pin received within the lock pin bore and moveable between a locked position in which the first end engages with a recess of the housing assembly, preventing angular motion between the housing assembly and the rotor assembly and an unlocked position in which the first end is disengaged from the recess of the housing assembly;

a vane passage extending between the at least one advance chamber or the at least one retard chamber and the lock pin bore;

a vane face passage on a face of a vane of the at least first vane extending between the lock pin bore and the at least one retard chamber or the at least one advance chamber;

an oil control valve in fluid connection with the at least one advance chamber, the at least one retard chamber, and a supply of fluid;

wherein in the locked position of the lock pin, fluid is prevented from exhausting from the at least one advance chamber and/or the at least one retard chamber to the lock pin bore and fluid is prevented from flowing to the at least one advance chamber and/or the at least one retard chamber by the lock pin.

2. The variable cam timing phaser of claim 1, further comprising a rotor passage extending between the lock pin bore and the bore of the rotor assembly.

3. The variable cam timing phaser of claim 1, wherein the rotor assembly further comprises:

a second vane extending from the rotor body of the rotor assembly, the second vane separating a second chamber of the at least one chamber defined between the rotor assembly and the housing assembly into a second advance chamber of the at least one advance chamber and a second retard chamber of the at least one retard chamber; and a third vane extending from the rotor body of the rotor assembly separating a third chamber of the at least one chamber defined between the rotor assembly and the housing assembly into a third advance chamber of the at least one advance chamber and a third retard chamber of the at least one retard chamber.

4. The variable cam timing phaser of claim 3, further comprising a third advance passage between the third advance chamber and the bore; a third retard passage between the third retard chamber and the bore; a second advance passage between the second advance chamber and the bore; and a second retard passage between the second retard chamber and the bore.

5. The variable cam timing phaser of claim 3, wherein the at least one advance chamber comprises a first advance chamber and the at least one retard chamber comprises a first retard chamber, and further comprising a single face passage extending to the second retard chamber and the third retard chamber from the first retard chamber and connecting the second retard chamber and the third retard chamber to the first retard chamber, such that fluid flows from the supply of fluid, through the oil control valve to the lock pin and to the first retard chamber after the lock pin unlocks.

6. The variable cam timing phaser of claim 3, wherein the at least one advance chamber comprises a first advance chamber and the at least one retard chamber comprises a first retard chamber, and further comprising a single face passage extending to the second advance chamber and the third advance chamber from the first advance chamber and connecting the second advance chamber and the third advance chamber to the first advance chamber, such that fluid flows from the supply of fluid, through the oil control valve to the lock pin and to the first advance chamber after the lock pin unlocks.

7. The variable cam timing phaser of claim 1, wherein the body of the lock pin further comprises at least three lands, and at least two annuli between the first end and the second end of the body and a full diameter at the first end to engage the recess in the locked position, such that when the lock pin is moved from the locked position to the unlocked position, the at least two annuli either exhaust fluid to the at least one advance chamber or the at least one retard chamber or supply fluid to the at least one advance chamber or the at least one retard chamber.

8. The variable cam timing phaser of claim 1, wherein the variable cam timing phaser is oil pressure actuated.

9. The variable cam timing phaser of claim 1, wherein the at least one chamber has a first wall adjacent the at least one advance chamber and a second wall adjacent the at least one retard chamber, wherein when the lock pin is in the locked position, the at least first vane is selected from a position of: between the first wall and the second wall of the at least one chamber, adjacent the first wall in the at least one advance chamber and adjacent the second wall in the at least one retard chamber.

10. The variable cam timing phaser of claim 1, wherein the first end of the body of the lock pin has a stepped diameter that engages the recess in the locked position, the body of the lock pin further comprising at least two lands, and at least one annulus between the first end and the second end of the body, such that when the lock pin is moved from the locked position to the unlocked position, the at least one annulus and the stepped diameter of the first end of the body of the lock pin either exhaust fluid to the at least one advance chamber or the at least one retard chamber or the supply of fluid to the at least one advance chamber or the at least one retard chamber.

11. A variable cam timing phaser comprising:

a housing assembly having an outer circumference for accepting drive force;

a rotor assembly connected to a camshaft, the rotor assembly coaxially located within the housing assembly, at least one chamber defined by the housing assembly and the rotor assembly, the rotor assembly comprising: a rotor body defining a bore and having at least a first vane extending therefrom, the at least first vane of the rotor assembly received within the at least one chamber, separating the at least one chamber into at least one advance chamber and at least one retard chamber, the at least first vane defining a lock pin bore, the at least first vane within the at least one chamber acting to shift relative angular position of the housing assembly and the rotor assembly;

a lock pin having a body comprising a first end and a second end, the lock pin received within the lock pin bore and moveable between a locked position in which the first end engages with a recess of the housing assembly, preventing angular motion between the housing assembly and the rotor assembly and an unlocked position in which the first end is disengaged from the recess of the housing assembly, wherein the body of the lock pin further comprises at least three lands, and at least two annuli between the first end and the second end of the body and a full diameter at the first end to engage the recess in the locked position, such that when the lock pin is moved from the locked position to the unlocked position, the at least two annuli either exhaust fluid to the at least one advance chamber or the at least one retard chamber or supply fluid to the at least one advance chamber or the at least one retard chamber;

a vane passage extending between the at least one advance chamber or the at least one retard chamber and the lock pin bore;

a vane face passage on a face of a vane of the at least first vane extending between the lock pin bore and the at least one retard chamber or the at least one advance chamber; and an oil control valve in fluid connection with the at least one advance chamber, the at least one retard chamber, and a supply of fluid;

wherein fluid connection between the supply of fluid and the at least one advance chamber or the at least one retard chamber through the oil control valve is present only when the lock pin is in the unlocked position.

12. The variable cam timing phaser of claim 11, further comprising a rotor passage extending between the lock pin bore and the bore of the rotor assembly.

13. The variable cam timing phaser of claim 11, wherein the rotor assembly further comprises:

a second vane extending from the rotor body of the rotor assembly, the second vane separating a second chamber of the at least one chamber defined between the rotor assembly and the housing assembly into a second advance chamber of the at least one advance chamber and a second retard chamber of the at least one retard chamber; and a third vane extending from the rotor body of the rotor assembly separating a third chamber of the at least one chamber defined between the rotor assembly and the housing assembly into a third advance chamber of the at least one advance chamber and a third retard chamber of the at least one retard chamber.

14. The variable cam timing phaser of claim 13, further comprising a third advance passage between the third advance chamber and the bore; a third retard passage between the third retard chamber and the bore; a second advance passage between the second advance chamber and the bore; and a second retard passage between the second retard chamber and the bore.

15. The variable cam timing phaser of claim 13, wherein the at least one advance chamber comprises a first advance chamber and the at least one retard chamber comprises a first retard chamber, and further comprising a single face passage to the second retard chamber and the third retard chamber from the first retard chamber and connecting the second retard chamber and the third retard chamber to the first retard chamber, such that fluid flows from the supply of fluid, through the oil control valve to the lock pin and to the first retard chamber after the lock pin unlocks.

16. The variable cam timing phaser of claim 13, wherein the at least one advance chamber comprises a first advance chamber and the at least one retard chamber comprises a first retard chamber, and further comprising a single face passage extending to the second advance chamber and the third advance chamber from the first advance chamber and connecting the second advance chamber and the third advance chamber to the first advance chamber, such that fluid flows from the supply of fluid, through the oil control valve to the lock pin and to the first advance chamber after the lock pin unlocks.

17. The variable cam timing phaser of claim 11, wherein the variable cam timing phaser is oil pressure actuated.

18. The variable cam timing phaser of claim 11, wherein the at least one chamber has a first wall adjacent the at least one advance chamber and a second wall adjacent the at least one retard chamber, wherein when the lock pin is in the locked position, the at least first vane is selected from a position of: between the first wall and the second wall of the at least one chamber, adjacent the first wall in the at least one advance chamber and adjacent the second wall in the at least one retard chamber.

19. A variable cam timing phaser comprising:

a housing assembly having an outer circumference for accepting drive force;

a rotor assembly connected to a camshaft, the rotor assembly coaxially located within the housing assembly, at least one chamber defined by the housing assembly and the rotor assembly, the rotor assembly comprising: a rotor body defining a bore and having at least a first vane extending therefrom, the at least first vane of the rotor assembly received within the at least one chamber, separating the at least one chamber into at least one advance chamber and at least one retard chamber, the at least first vane defining a lock pin bore, the at least first vane within the at least one chamber acting to shift relative angular position of the housing assembly and the rotor assembly;

a lock pin having a body comprising a first end and a second end, the lock pin received within the lock pin bore and moveable between a locked position in which the first end engages with a recess of the housing assembly, preventing angular motion between the housing assembly and the rotor assembly and an unlocked position in which the first end is disengaged from the recess of the housing assembly, wherein the first end of the body of the lock pin has a stepped diameter that engages the recess in the locked position, the body of the lock pin further comprising at least two lands, and at least one annulus between the first end and the second end of the body;

a vane passage extending between the at least one advance chamber or the at least one retard chamber and the lock pin bore;

a vane face passage on a face of a vane of the at least first vane extending between the lock pin bore and the at least one retard chamber or the at least one advance chamber; and an oil control valve in fluid connection with the at least one advance chamber, the at least one retard chamber, and a supply of fluid;

wherein fluid connection between the supply of fluid and the at least one advance chamber or the at least one retard chamber through the oil control valve is present only when the lock pin is in the unlocked position;

wherein when the lock pin is moved from the locked position to the unlocked position, the at least one annulus and the stepped diameter of the first end of the body of the lock pin either exhaust fluid to the at least one advance chamber or the at least one retard chamber or the supply of fluid to the at least one advance chamber or the at least one retard chamber.

20. The variable cam timing phaser of claim 19, further comprising a rotor passage extending between the lock pin bore and the bore of the rotor assembly.

21. The variable cam timing phaser of claim 19, wherein the rotor assembly further comprises:

a second vane extending from the rotor body of the rotor assembly, the second vane separating a second chamber of the at least one chamber defined between the rotor assembly and the housing assembly into a second advance chamber of the at least one advance chamber and a second retard chamber of the at least one retard chamber; and a third vane extending from the rotor body of the rotor assembly separating a third chamber of the at least one chamber defined between the rotor assembly and the housing assembly into a third advance chamber of the at least one advance chamber and a third retard chamber of the at least one retard chamber.

22. The variable cam timing phaser of claim 21, further comprising a third advance passage between the third advance chamber and the bore; a third retard passage between the third retard chamber and the bore; a second advance passage between the second advance chamber and the bore; and a second retard passage between the second retard chamber and the bore.

23. The variable cam timing phaser of claim 21, wherein the at least one advance chamber comprises a first advance chamber and the at least one retard chamber comprises a first retard chamber, and further comprising a single face passage to the second retard chamber and the third retard chamber from the first retard chamber and connecting the second retard chamber and the third retard chamber to the first retard chamber, such that fluid flows from the supply of fluid, through the oil control valve to the lock pin and to the first retard chamber after the lock pin unlocks.

24. The variable cam timing phaser of claim 21, wherein the at least one advance chamber comprises a first advance chamber and the at least one retard chamber comprises a first retard chamber, and further comprising a single face passage extending to the second advance chamber and the third advance chamber from the first advance chamber and connecting the second advance chamber and the third advance chamber to the first advance chamber, such that fluid flows from the supply of fluid, through the oil control valve to the lock pin and to the first advance chamber after the lock pin unlocks.

25. The variable cam timing phaser of claim 19, wherein the variable cam timing phaser is oil pressure actuated.

26. The variable cam timing phaser of claim 19, wherein the at least one chamber has a first wall adjacent the at least one advance chamber and a second wall adjacent the at least one retard chamber, wherein when the lock pin is in the locked position, the at least first vane is selected from a position of: between the first wall and the second wall of the at least one chamber, adjacent the first wall in the at least one advance chamber and adjacent the second wall in the at least one retard chamber.

* * * * *